US010081521B2

(12) United States Patent
Nipper

(10) Patent No.: US 10,081,521 B2
(45) Date of Patent: Sep. 25, 2018

(54) LOAD SECURING PULLEY SYSTEM

(71) Applicant: Jerry Nipper, Rockport, AR (US)

(72) Inventor: Jerry Nipper, Rockport, AR (US)

( * ) Notice: Subject to any disclaimer, the term of this patent is extended or adjusted under 35 U.S.C. 154(b) by 131 days.

(21) Appl. No.: 15/282,953

(22) Filed: Sep. 30, 2016

(65) Prior Publication Data

US 2018/0093871 A1 Apr. 5, 2018

(51) Int. Cl.
*B66D 3/10* (2006.01)
*B66D 3/04* (2006.01)

(52) U.S. Cl.
CPC ..... *B66D 3/10* (2013.01); *B66D 3/04* (2013.01)

(58) Field of Classification Search
CPC ..... B66D 3/04; B66D 5/00; B66D 2700/026; B66D 3/10
See application file for complete search history.

(56) References Cited

U.S. PATENT DOCUMENTS 173,370 A * 2/1876 Tarbox ..... B66D 3/04 254/409
765,475 A * 7/1904 Gilohrist ..... B66D 3/046 254/405
806,562 A * 12/1905 Opsal ..... B66D 3/046 254/405
1,242,636 A * 10/1917 Ankrom ..... B66D 3/04 254/411
1,273,315 A * 7/1918 Bell et al. ..... B66D 3/04 254/410
1,327,876 A * 1/1920 Nyblad ..... B66D 3/04 116/173
1,347,211 A * 7/1920 Crosby ..... B66D 3/04 254/409
1,519,520 A * 12/1924 Warren ..... B66D 3/04 254/390
2,254,828 A * 9/1941 Linn ..... B66D 3/04 254/411
2,523,440 A * 9/1950 Mcenary ..... B66D 3/04 254/406
3,403,578 A * 10/1968 Morse ..... B63H 21/265 114/160
3,773,295 A * 11/1973 Holmes ..... B66D 3/04 254/409
3,899,158 A * 8/1975 Johnson ..... B66D 3/04 254/405
5,368,281 A * 11/1994 Skyba ..... B25B 25/00 254/217

(Continued)

*Primary Examiner* — Michael E Gallion

(57) ABSTRACT

A load securing pulley supports the weight of a hoisted load by restraining a load-support cord in order to maintain tension within the load-support cord between the hoisted load and the load securing pulley. The load securing pulley includes a wheel-supporting housing, a wheel-receiving opening, a hook retention eye, a rope lock, and a pulley wheel. The hook retention eye is connected to the wheel-supporting housing such that the present invention is able to be suspended from a hook to a raised horizontal support. The wheel-receiving opening laterally traverses into the wheel-supporting housing in order to allow the pulley wheel to be positioned and rotate within the wheel-supporting housing. The rope lock allows for the load-support cord to be secured to the present invention through tension due to the weight of the hoisted load.

5 Claims, 7 Drawing Sheets

(56) References Cited

U.S. PATENT DOCUMENTS

| | | | | |
|---|---|---|---|---|
| 6,974,125 | B2 * | 12/2005 | Renton | B63B 21/04 254/409 |
| 7,562,862 | B1 * | 7/2009 | Jackson | B66D 3/14 254/333 |
| 7,735,809 | B2 * | 6/2010 | Maire | B66D 3/06 24/129 R |
| 8,974,334 | B2 * | 3/2015 | Stephenson | B66D 1/7405 182/107 |
| 2004/0144964 | A1 * | 7/2004 | Boice | B60P 3/075 254/223 |
| 2010/0084621 | A1 * | 4/2010 | Raineri | H02G 1/08 254/134.3 R |
| 2014/0106916 | A1 * | 4/2014 | Cocca | B66D 3/04 474/144 |

* cited by examiner

LOAD SECURING PULLEY SYSTEM

FIELD OF THE INVENTION

The present invention relates generally to a hoisting system. More specifically, the present invention relates to a pulley system that allows a cord to be locked in place in order to support a load at a fixed height.

BACKGROUND OF THE INVENTION

Pulleys allow a load to be raised or pulled with ease by changing the direction of force applied to a cord needed to manipulate the weight of the load. Traditionally, the pulley supports the raised load by securing a free end for the cord to an external support, such as a wall-mounted hook or clasp, a ground stake, or even a trunk of a tree, after the load is raised. The cord can be a tripping hazard or obstruction to people or animals walking around the external support.

The present invention is a load securing pulley system which secures a raised load without tethering the cord to an external support. The cord is fastened directly to a wheel-supporting housing in order to maintain tension in the cord to support the weight of the load. Therefore, the present invention is able to reduce or eliminate tripping hazards or obstructions around the present invention as the present invention is implemented. The present invention is able to be mounted onto a vertical support, such as a tree or post, through a boom in order to set the max height and the distance from the vertical support which the load is able to be raised.

The present invention was conceived in order to be connected to a telescopic boom. The present invention allows the telescopic boom to change length the telescopic boom extends from a vertical support without modifying the height of a suspended load as the load is suspended by the present invention. If the load was instead tethered to the vertical support which the telescopic boom is connected or another support to fix a cord supporting the load, the load would change elevation as the telescopic boom extends or retracts.

DETAIL DESCRIPTIONS OF THE INVENTION

All illustrations of the drawings are for the purpose of describing selected versions of the present invention and are not intended to limit the scope of the present invention.

The present invention is a load securing pulley. Through implementation of the present invention, a user is able to lift a weighted load with ease through a pulley mechanism and secure the load adjacent to the pulley mechanism. Therefore, the present invention is able to reduce tripping or obstruction of movement around the present invention as the weighted load is not tied to a vertical support, such as a ground stake or tree trunk, directly.

Figure 1:
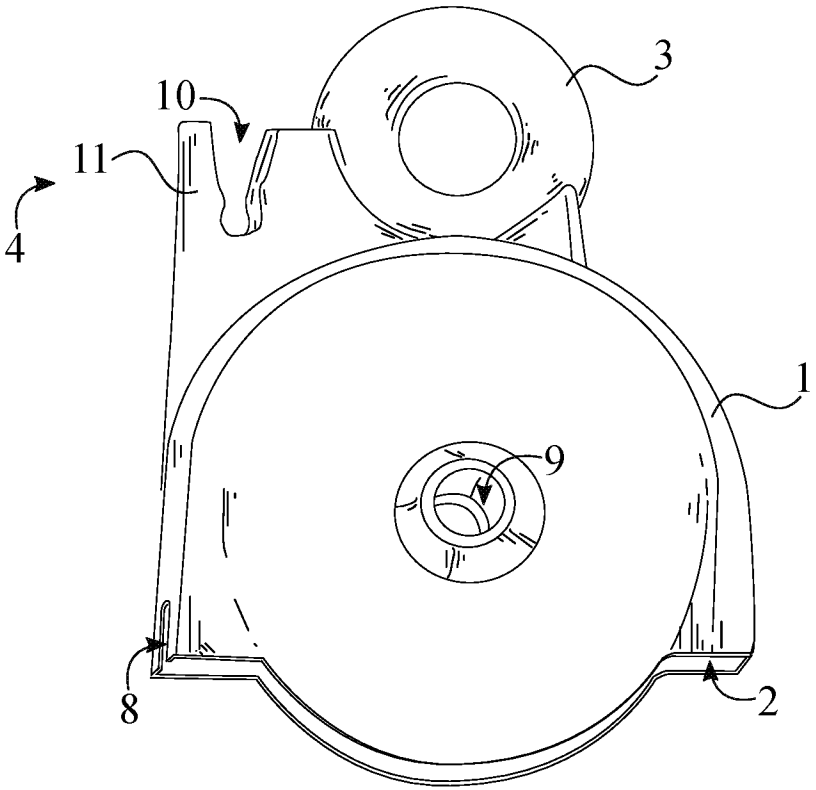
FIG. 1 is a perspective view of wheel-housing support of the present invention.
Figure 2:
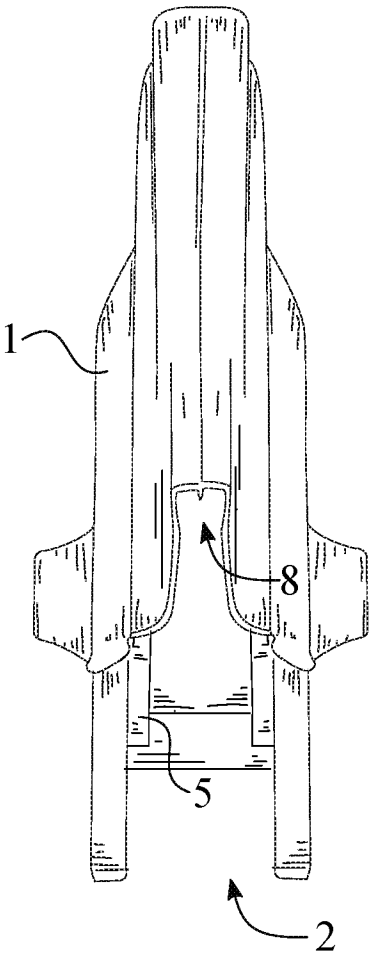
FIG. 2 is a front perspective view of the present invention.
Figure 3:
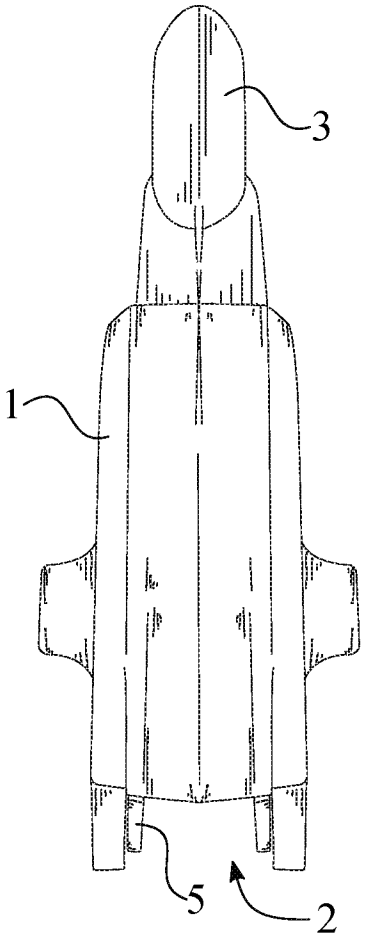
FIG. 3 is a rear view of the present invention.

The present invention comprises a wheel-supporting housing 1, a wheel-receiving opening 2, a hook retention eye 3, a rope lock 4, and a pulley wheel 5. The wheel-supporting housing 1 supports the pulley wheel 5. The wheel-receiving opening 2 laterally traverses into the wheel-supporting housing 1 in order to allow the pulley wheel 5 to be received within the wheel-supporting housing 1, as shown in FIG. 1 to FIG. 3. The hook retention eye 3 allows the wheel-supporting housing 1 to be hung by a hook or clasp in order to raise a load tethered to the present invention effectively. In accordance to FIG. 1, FIG. 3, FIG. 4, and FIG. 6, the hook retention eye 3 is laterally connected to the wheel-supporting housing 1, opposite to the wheel-receiving opening 2 in order to allow the pulley wheel 5 to be oriented for effective use. The rope lock 4 secures a cord or rope in order to keep tension within the cord or rope to suspend the weight of a load. As detailed in FIG. 1, FIG. 6, and FIG. 7, the rope lock 4 is laterally connected to the wheel-supporting housing 1, adjacent to the hook retention eye 3. The pulley wheel 5 allows the user to translate a pulling force into a lifting force for the load with ease. The pulley wheel 5 is positioned within the wheel-supporting housing 1 through the wheel-receiving opening 2, in accordance to FIG. 5 and FIG. 6. The pulley wheel 5 is rotatably mounted to the wheel-supporting housing 1. This configuration for the pulley wheel 5 allows the cord or rope to be guided around the pulley wheel 5, as well as, reducing the force the user needs to exert on the cord or rope in order to raise a load tethered to the rope or cord.

Figure 4:
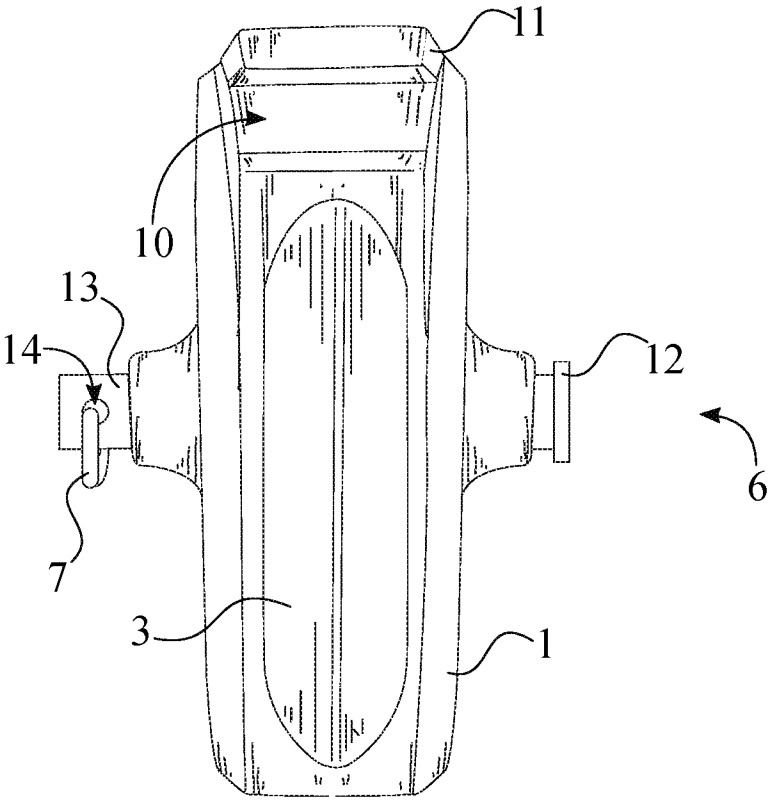
FIG. 4 is a top view of the present invention, wherein a pin traverses through the wheel-supporting housing.
Figure 5:
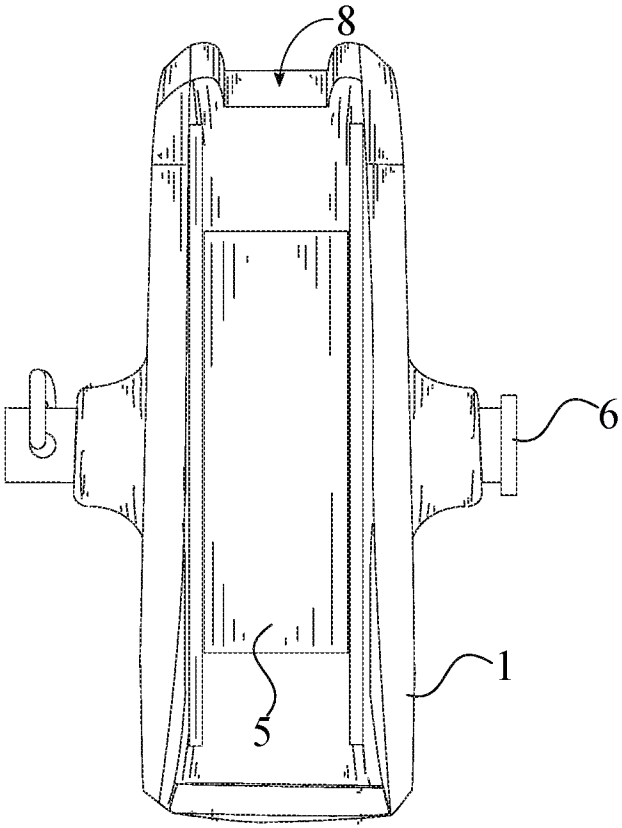
FIG. 5 is bottom view of the present invention, wherein a pin traverses through the wheel-supporting housing.
Figure 6:
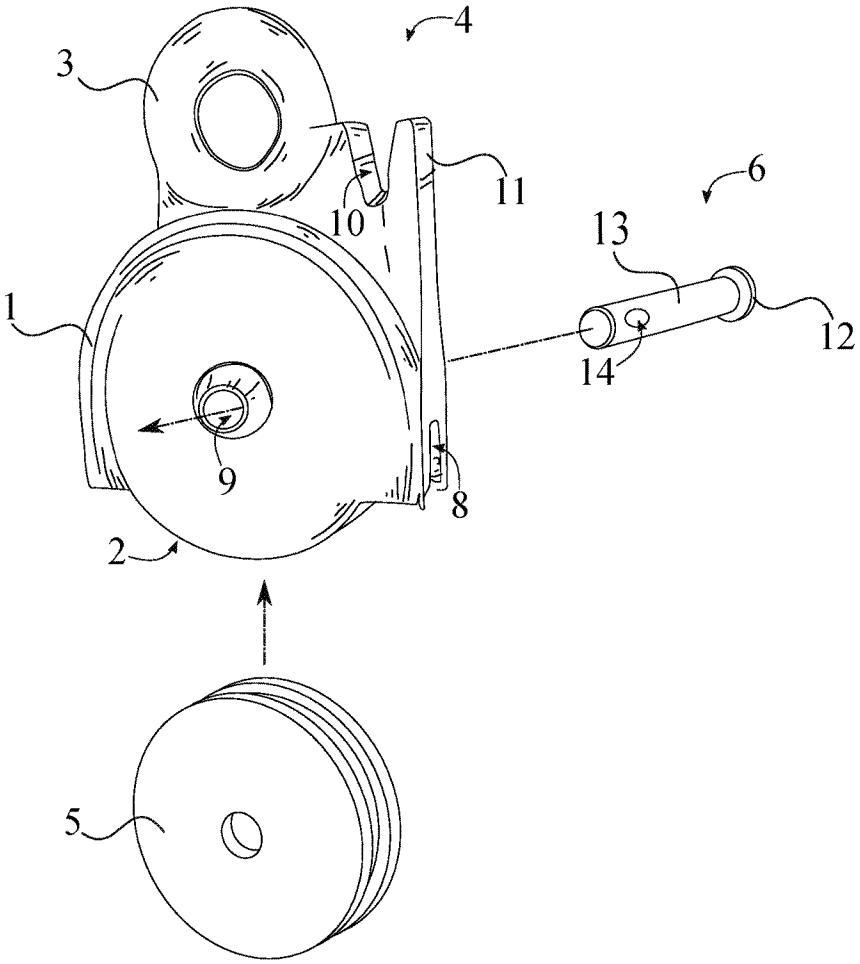
FIG. 6 is an exploded view of the present invention.
Figure 7:
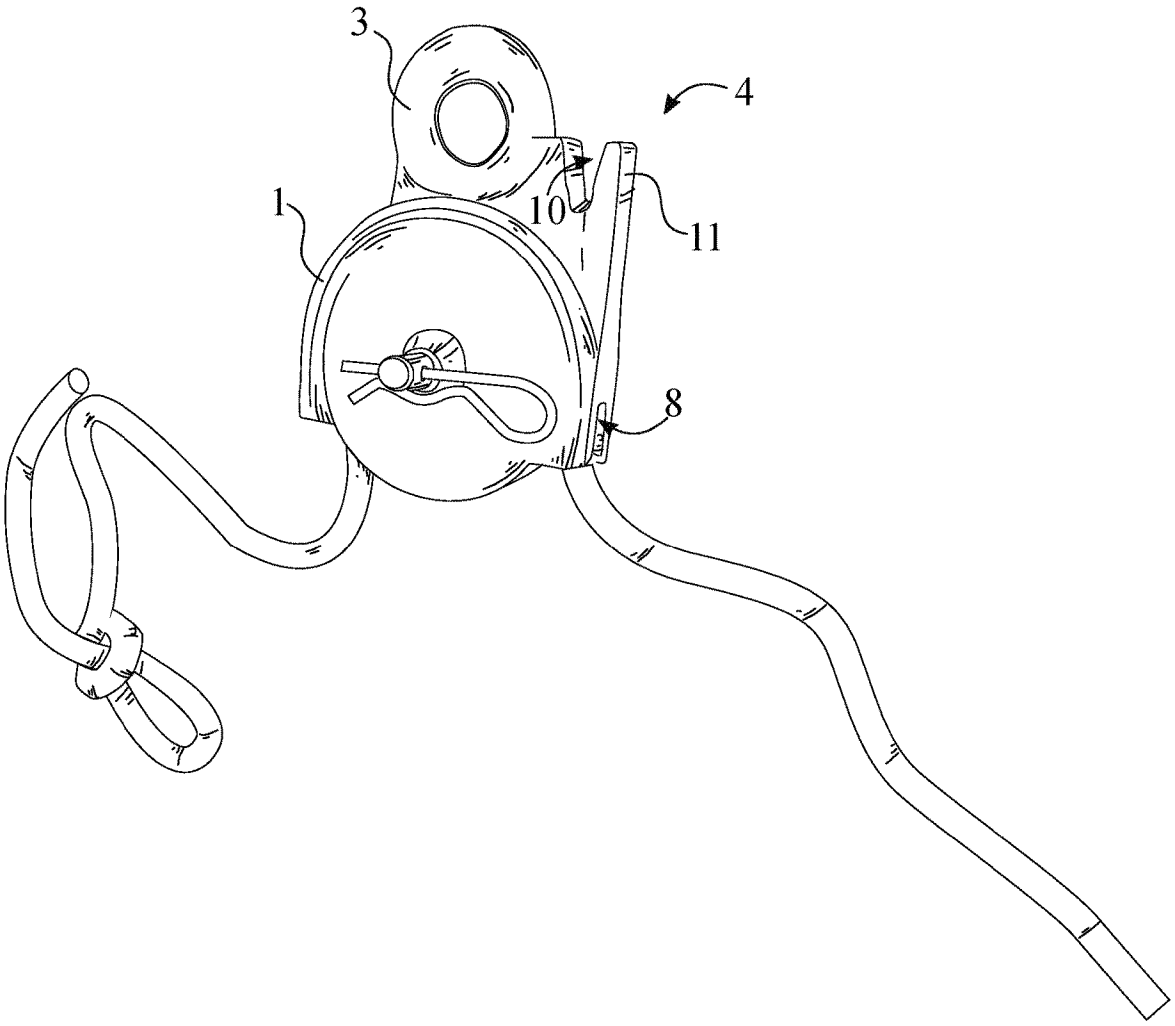
FIG. 7 is a perspective view of assembled the present invention, wherein a cord or rope is threaded about the pulley wheel within the wheel-supporting housing.

In accordance to the preferred embodiment of the present invention, the present invention comprises a pin 6, as detailed in FIG. 4 and FIG. 6. The pin 6 provides a rotational axis for the pulley wheel 5. The wheel-supporting housing 1 comprises a pin-supporting hole 9, as shown in FIG. 6. The pin-supporting hole 9 supports the pin 6 on the wheel-supporting housing 1. The pin-supporting hole 9 traverses through the wheel-supporting housing 1. More specifically, the pin-supporting hole 9 is centrally positioned with the pulley wheel 5. The pin 6 is positioned within the pin-supporting hole 9. The pulley wheel 5 is rotatably connected to the pin 6. This configuration allows the pulley wheel 5 to rotate freely about the pin 6 in order to reduce friction during implementation of the present invention as a cord is forced around the pulley wheel 5.

Further in accordance to the preferred embodiment of the present invention, the present invention comprises a hairpin clip 7, as shown in FIG. 4. The hairpin clip 7 secures the pin 6 to the wheel-supporting housing 1. The pin 6 comprises a pinhead 12, a shank 13, and a clip-receiving hole 14, in accordance to FIG. 4 and FIG. 6. The pinhead 12 and the hairpin clip 7 prevent the pin 6 from being dislodged from the wheel-supporting housing 1. The pinhead 12 is terminally connected to the shank 13. The clip-receiving hole 14 laterally traverses through the shank 13. The clip-receiving hole 14 is opposite to the pinhead 12 along the shank 13. The hairpin clip 7 is engaged with the clip-receiving hole 14. The wheel-supporting housing 1 is positioned between the pinhead 12 and the hairpin clip 7 in order to prevent the pin 6 from being dislodged from the pin-supporting hole 9. This configuration secures the pulley wheel 5 within the wheel-supporting housing 1 by restraining the pin 6 within the pin-supporting hole 9.

In accordance to the preferred embodiment of the rope lock 4, the rope lock 4 comprises a rope-receiving notch 10 and a rope-securing extrusion 11. The rope-receiving notch 10 and the rope-securing extrusion 11 secure a cord to the wheel-supporting housing 1. In accordance to FIG. 1, FIG. 6 and FIG. 7, the rope-securing extrusion 11 is laterally connected to the wheel-supporting housing 1 and the hook retention eye 3. The rope-receiving notch 10 traverses into the rope-securing extrusion 11 in order to allow a rope or a cord to be placed between the hook retention eye 3 and the rope-securing extrusion 11. The rope-receiving notch 10 is positioned opposite to the wheel-receiving opening 2, about the wheel-supporting housing 1, in order to provide an anchor point for the cord or rope to maintain tension in the cord or rope to support a load.

In accordance to the preferred embodiment of the present invention, the present invention further comprises a rope-restraining notch 8, as shown in FIG. 1, FIG. 2, FIG. 5 to FIG. 7, and the wheel-supporting housing 1 comprises an internal surface 15 and an external surface 16. The rope-restraining notch 8 aligns the rope or cord with the pulley wheel 5 as the cord or rope is positioned by the user within the rope lock 4. The rope-restraining notch 8 traverses through the wheel-supporting housing 1 from the external surface 16 to the internal surface 15. The rope-restraining notch 8 is positioned adjacent to the wheel-receiving opening 2. The rope-restraining notch 8 is also radially positioned between the rope lock 4 and the wheel-receiving opening 2, in order to maintain alignment for the rope or cord with the pulley wheel 5 and reduce abrasion to the rope or cord from sliding about the wheel-receiving opening 2.

In some implementations of the present invention, the present invention is suspended from a raised horizontal support, such as a telescopic boom, a branch, or cantilever in order to raise a hoist load with ease. The hoist load is fastened to a first end of a load support cord. The load-support cord is tensionably engaged the pulley wheel 5 between the first end of the load-support cord and a second end of the load support cord. A portion of the load-support cord, between the pulley wheel 5 and the second end of the load-support cord, engages the rope-restraining notch 8 and subsequently the rope-receiving notch 10, in order to anchor the load-support cord allowing tension within the load-support cord to support the hoist load.

Although the invention has been explained in relation to its preferred embodiment, it is to be understood that many other possible modifications and variations can be made without departing from the spirit and scope of the invention as hereinafter claimed.

What is claimed is:

1. A load securing pulley comprising:
a wheel-supporting housing;
a wheel-receiving opening;
a hook retention eye;
a rope lock;
a pulley wheel;
the wheel-receiving opening laterally traversing into the wheel-supporting housing;
the rope lock comprising a rope-receiving notch and a rope-securing extrusion;
the hook retention eye being laterally connected to the wheel-supporting housing, opposite to the wheel-receiving opening;
the rope lock being laterally connected to the wheel-supporting housing, adjacent to the hook retention eye;
the pulley wheel being positioned within the wheel-supporting housing through the wheel-receiving opening;
the pulley wheel being rotatably mounted to the wheel-supporting housing;
the rope-securing extrusion being laterally connected to the wheel-supporting housing and the hook retention eye;
the rope-receiving notch traversing into the rope-securing extrusion;
the wheel-supporting housing being located in between the rope-receiving notch and the wheel-receiving opening; and
the rope-receiving notch being not communicated with the wheel-receiving opening; wherein the hook retention eye being positioned in between both ends of the wheel-supporting housing.

2. The load securing pulley, as claimed in claim 1, comprising:
a pin;
the wheel-supporting housing comprising a pin-supporting hole;
the pin-supporting hole traversing through the wheel-supporting housing;
the pin being positioned within the pin-supporting hole; and
the pulley wheel being rotatably connected to the pin.

3. The load securing pulley, as claimed in claim 2, comprising:
a hairpin clip;
the pin comprising a pinhead, a shank, and a clip-receiving hole;
the pinhead being terminally connected to the shank;
the clip-receiving hole laterally traversing through the shank;
the clip-receiving hole being opposite to the pinhead along the shank;
the hairpin clip being engaged with the clip-receiving hole; and
the wheel-supporting housing being positioned between the pinhead and the hairpin clip.

4. The load securing pulley, as claimed in claim 2, comprising:
the pin-supporting hole being centrally positioned with the pulley wheel.

5. The load securing pulley, as claimed in claim 1, comprising:
a rope-restraining notch;
the wheel-supporting housing comprising an internal surface and an external surface;
the rope-restraining notch traversing through the wheel-supporting housing from the external surface to the internal surface;
the rope-restraining notch being positioned adjacent to the wheel-receiving opening; and
the rope-restraining notch being radially positioned between the rope lock and the wheel-receiving opening.

* * * * *